US009318019B2

(12) United States Patent
Muramatsu et al.

(10) Patent No.: US 9,318,019 B2
(45) Date of Patent: Apr. 19, 2016

(54) TRAFFIC-RELATED INFORMATION DICTIONARY CREATING DEVICE, TRAFFIC-RELATED INFORMATION DICTIONARY CREATING METHOD, AND TRAFFIC-RELATED INFORMATION DICTIONARY CREATING PROGRAM

(75) Inventors: Ryuya Muramatsu, Okazaki (JP); Hirokazu Nomoto, Toyokawa (JP); Hideo Yamada, Okazaki (JP)

(73) Assignee: AISIN AW CO., LTD., Anjo (JP)

( * ) Notice: Subject to any disclaimer, the term of this patent is extended or adjusted under 35 U.S.C. 154(b) by 436 days.

(21) Appl. No.: 13/297,935

(22) Filed: Nov. 16, 2011

(65) Prior Publication Data

US 2012/0136560 A1 May 31, 2012

(30) Foreign Application Priority Data

Nov. 30, 2010 (JP) ..... 2010-267810

(51) Int. Cl.
*G08G 1/00* (2006.01)
*G08G 1/01* (2006.01)

(52) U.S. Cl.
CPC ..... *G08G 1/0133* (2013.01)

(58) Field of Classification Search
CPC ..... G08G 1/0104; G08G 1/096716; G08G 1/096775; G08G 1/096741; G08G 1/20
USPC ..... 701/117, 118, 119, 400, 408, 409, 450, 701/451; 340/995.13, 995.14, 995.24, 988
See application file for complete search history.

(56) References Cited

U.S. PATENT DOCUMENTS 7,277,028 B1 10/2007 Janke
7,417,559 B1 * 8/2008 Janke ..... 340/905
(Continued)

FOREIGN PATENT DOCUMENTS

| | | |
|---|---|---|
| JP | A-11-250067 | 9/1999 |
| JP | A 2002-099531 | 4/2002 |
| JP | A-2003-099456 | 4/2003 |
| JP | A-2003-532210 | 10/2003 |
| JP | A-2007-298499 | 11/2007 |
| WO | WO 01/82562 A2 | 11/2001 |

OTHER PUBLICATIONS

Japanese Patent Office, Notification of Reason(s) for Refusal mailed Jan. 7, 2014 in Japanese Patent Application No. 2010-267810 w/Partial English-language Translation.

*Primary Examiner* — Mussa A Shaawat
(74) *Attorney, Agent, or Firm* — Oliff PLC

(57) ABSTRACT

Devices, methods, and programs acquire provided information and position information that corresponds to the provided information from a provided information storage unit. The provided information has been provided to the provided information storage unit by an information provider and stored in the provided information unit with the position information. The position information specifies a position at which the provided information was provided by the information provider. The devices, methods, and programs acquire traffic-related information from a traffic-related information distribution unit. The traffic-related information includes information that specifies an occurring traffic-related event and information that specifies a range of the occurring traffic-related event. Based on the acquired position information and the acquired traffic-related information, the devices, methods, and programs identify the provided information that is provided within the range of the occurring traffic-related event, and associate and store a phrase included in the identified provided information with the occurring traffic-related event.

12 Claims, 6 Drawing Sheets

(56) References Cited

U.S. PATENT DOCUMENTS

| | | | | |
|---|---|---|---|---|
| 7,760,110 | B1 * | 7/2010 | Janke | 340/902 |
| 7,760,112 | B2 * | 7/2010 | Bauchot et al. | 340/905 |
| 8,019,535 | B2 * | 9/2011 | Endo et al. | 701/450 |
| 2001/0029425 | A1 * | 10/2001 | Myr | 701/200 |
| 2007/0050128 | A1 * | 3/2007 | Lee et al. | 701/200 |
| 2007/0055441 | A1 * | 3/2007 | Retterath et al. | 701/200 |
| 2007/0179711 | A1 * | 8/2007 | Tobiyama et al. | 701/211 |
| 2007/0198176 | A1 | 8/2007 | Endo et al. | |
| 2007/0203642 | A1 * | 8/2007 | Arnold-Huyser | 701/211 |
| 2008/0070559 | A1 * | 3/2008 | Behr et al. | 455/414.2 |

* cited by examiner

FIG. 2

[KEYWORD DICTIONARY]

| PHRASE | EVENT | TOTAL USAGE |
|---|---|---|
| TRAFFIC CONGESTION | TRAFFIC CONGESTION | 532 |
| JAMMED | TRAFFIC CONGESTION | 311 |
| NOT MOVING FORWARD | TRAFFIC CONGESTION | 246 |
| BA JAM | TRAFFIC CONGESTION | 75 |
| SNAIL'S PACE | TRAFFIC CONGESTION | 18 |
| ⋮ | ⋮ | ⋮ |

FIG. 3

[USER DICTIONARY (INFORMATION PROVIDER: AA)]

| PHRASE | USER USAGE |
|---|---|
| TRAFFIC CONGESTION | 30 |
| JAMMED | 25 |
| NOT MOVING FORWARD | 22 |
| SNAIL'S PACE | 18 |
| ⋮ | ⋮ |

FIG. 4

[AREA DICTIONARY (AREA: AC DISTRICT)]

| PHRASE | AREA USAGE |
|---|---|
| TRAFFIC CONGESTION | 145 |
| JAMMED | 132 |
| NOT MOVING FORWARD | 111 |
| BA JAM | 75 |
| ⋮ | ⋮ |

FIG. 5

[TRAFFIC-RELATED INFORMATION DICTIONARY]

| PHRASE | EVENT | CLASS |
|---|---|---|
| TRAFFIC CONGESTION | TRAFFIC CONGESTION | ALL AREAS |
| JAMMED | TRAFFIC CONGESTION | ALL AREAS |
| NOT MOVING FORWARD | TRAFFIC CONGESTION | ALL AREAS |
| BA JAM | TRAFFIC CONGESTION | AC DISTRICT |
| SNAIL'S PACE | TRAFFIC CONGESTION | AA |
| ⋮ | ⋮ | ⋮ |

[PROVIDED INFORMATION PUBLIC SERVER]

| USER | PROVIDED INFORMATION | POSITION INFORMATION |
|---|---|---|
| AA | ···SNAIL'S PACE! | (x1 , y1) |
| BB | ···TRAFFIC JAM NOW. | (x2 , y2) |
| AA | ···JAMMED! | (x3 , y3) |
| CC | ···STILL NOT MOVING FORWARD | (x4 , y4) |
| ⋮ | ⋮ | ⋮ |

TRAFFIC-RELATED INFORMATION DICTIONARY CREATING DEVICE, TRAFFIC-RELATED INFORMATION DICTIONARY CREATING METHOD, AND TRAFFIC-RELATED INFORMATION DICTIONARY CREATING PROGRAM

INCORPORATION BY REFERENCE

The disclosure of Japanese Patent Application No. 2010-267810, filed on Nov. 30, 2010, including the specification, drawings, and abstract is incorporated herein by reference in its entirety.

BACKGROUND

1. Related Technical Fields

Related technical fields include traffic-related information dictionary creating devices, traffic-related information dictionary creating methods, and traffic-related information dictionary creating programs.

2. Related Art

According to related art, prescribed words included in a sentence are extracted and registered to a dictionary. For example, a word registration system has been proposed in which at least part of word data not registered in a user dictionary among word data received from a word data receiving unit is added and registered to the user dictionary. According to this word registration system, word data in which a word "reading" and corresponding kanji (Chinese characters) are pre-associated is received from a website through the internet. If the received word data is not registered in the user dictionary, the word data is added and registered in the user dictionary (see Japanese Patent Application Publication No. JP-A-2002-99531, for example).

SUMMARY

A traffic-related information dictionary can be created by associating traffic-related events and phrases that express such traffic-related events, and registering the associated traffic-related events and phrases. The traffic-related events include traffic congestion, traffic restrictions, road work, accidents, public events, weather, road slipperiness, space availability in parking lots, status of train delays, and the like. However, if a system according to related art as described above is used to register phrases in the traffic-related information dictionary, unless data that pre-associates the phrases with the corresponding traffic-related events is used, the phrases cannot be registered in the dictionary. Thus, phrases that are not pre-associated with traffic-related events because such phrases are not generally used to express traffic-related events (e.g., phrases used only in a particular region or phrases used only by a particular user) cannot be registered in the dictionary as associated with such traffic-related events.

Exemplary implementations of the broad inventive principles described herein provide a traffic-related information dictionary creating device, a traffic-related information dictionary creating method, and a traffic-related information dictionary creating program, which can register a phrase not generally used to express a traffic-related event as a phrase expressing such a traffic-related event in a traffic-related information dictionary.

According to exemplary implementations, based on position information acquired by a provided information acquisition unit and traffic-related information acquired by a traffic-related information acquisition unit, the provided information that is provided within a range of an occurring traffic-related event is specified. At least part of a phrase included in the specified provided information is associated with the occurring traffic-related event, and the associated at least partial phrase and traffic-related event are stored in a traffic-related information phrase storage unit. Therefore, even a phrase not generally used as a phrase to express a traffic-related event can be stored in the traffic-related information phrase storage unit as a phrase that expresses that particular traffic-related event.

According to exemplary implementations, a traffic-related information dictionary registration unit determines whether to store the phrase in the traffic-related information phrase storage unit based on a cumulative number of times the same phrase is included in the provided information that is provided within the range of the same type of occurring traffic-related event. Therefore, only a phrase used to a certain extent for the same type of traffic-related event can be stored in the traffic-related information phrase storage unit, which increases the reliability of the traffic-related information phrase storage unit.

According to exemplary implementations, the traffic-related information dictionary registration unit associates the phrase included in the provided information that is provided within the range of the occurring traffic-related event with provider identifying information that corresponds to the provided information including the phrase, and stores the associated phrase and provider identifying information in the traffic-related information phrase storage unit. Therefore, a phrase used only by a prescribed information provider and not generally used as a phrase that expresses the traffic-related event can also be stored in the traffic-related information phrase storage unit as an information provider-specific phrase that expresses the traffic-related event.

According to exemplary implementations, based on the position information acquired by the provided information acquisition unit, the traffic-related information dictionary registration unit associates the phrase included in the provided information that is provided within the range of the occurring traffic-related event with an area that includes the position at which the provided information including the phrase is provided, and stores the associated phrase and area in the traffic-related information phrase storage unit. Therefore, a phrase used only in a prescribed area and not generally used as a phrase that expresses the traffic-related event can also be stored in the traffic-related information phrase storage unit as an area-specific phrase that expresses the traffic-related event.

BRIEF DESCRIPTION OF THE DRAWINGS

FIG. 2 is a table that illustrates information stored in a keyword dictionary;

FIG. 3 is a table that illustrates information stored in a user dictionary for an information provider "AA";

FIG. 4 is a table that illustrates information stored in an area dictionary for an area "AC district" of a given range;

FIG. 5 is a table that illustrates information stored in a traffic-related information dictionary;

DETAILED DESCRIPTION OF EXEMPLARY IMPLEMENTATIONS

Hereinafter, an example of a traffic-related information dictionary creating device, a traffic-related information dictionary creating method, and a traffic-related information dictionary creating program will be described in detail with reference to the drawings.

I. Constitution

Figure 1:
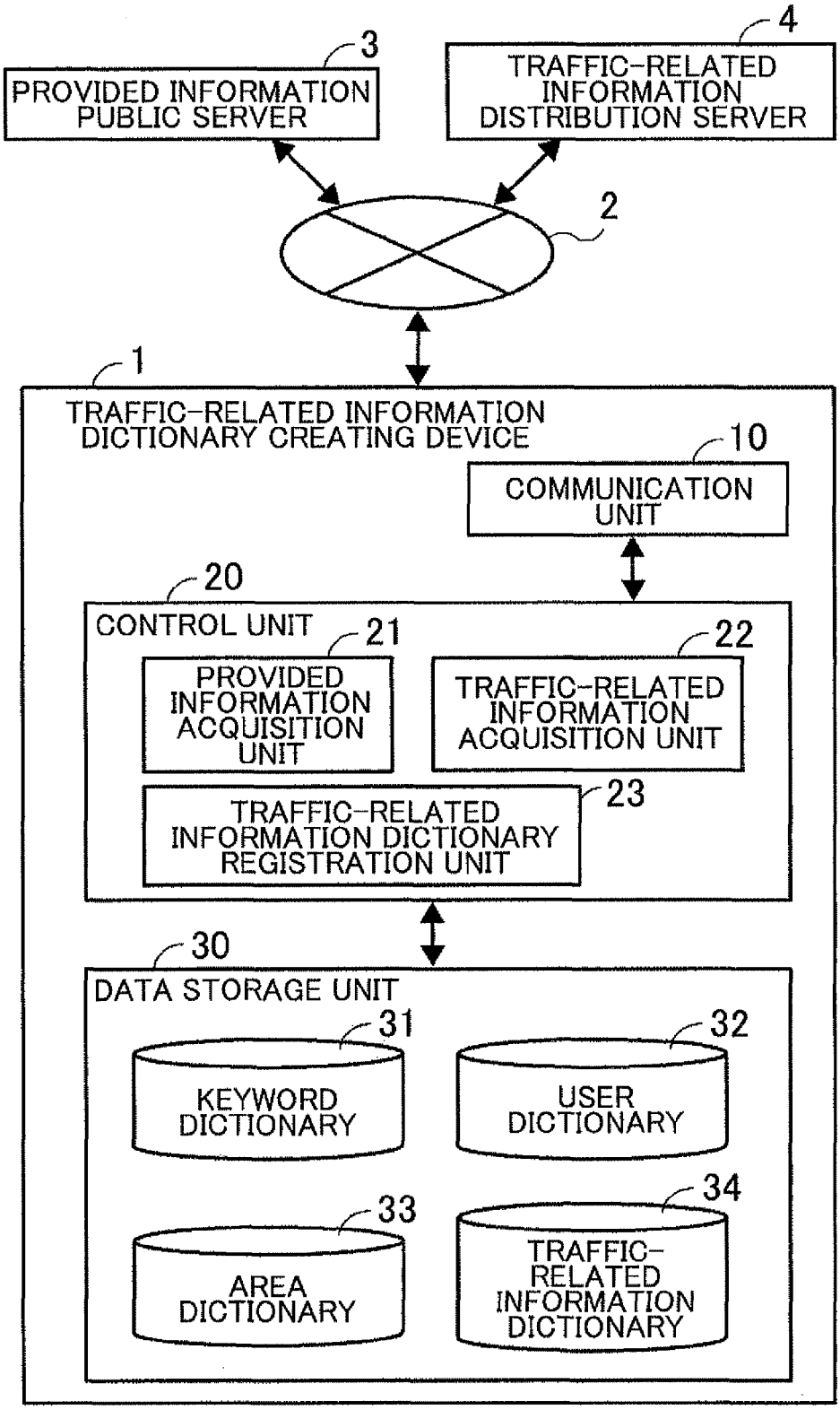
FIG. 1 is a block diagram that illustrates a traffic-related information dictionary creating device according to an example.

First, the constitution of the traffic-related information dictionary creating device according to the example will be described. FIG. 1 is a block diagram that illustrates the traffic-related information dictionary creating device according to the present example. As shown in FIG. 1, a traffic-related information dictionary creating device 1 is connected in a communicable manner through a network 2 to a provided information public server 3 and a traffic-related information distribution server 4.

The provided information public server 3 is a provided information storage unit that associates provided information from an information provider with position information that specifies a position at which the provided information is provided, and stores the associated provided information and position information. The specific content of the provided information public server 3 may take on any form, for example, a Social Networking Service (SNS) server or a server that hosts various blog sites may be used. A terminal (not shown in the drawing) is connected through the network 2 to the provided information public server 3. The provided information is uploaded in a text format by the information provider from the terminal to the provided information public server 3, and the provided information is readably stored in the provided information public server 3.

The traffic-related information distribution server 4 is a traffic-related information distribution unit that distributes traffic-related information. The traffic-related information includes information that specifies traffic-related events (e.g., traffic congestion, traffic restrictions, road work, accidents, public events, weather, road slipperiness, space availability in parking lots, and status of train delays), and information that specifies a range of the occurring traffic-related events. As the traffic-related information distribution server 4, for example, a distribution server that distributes the traffic-related information through FM multiplex broadcasting, beacons, or the like in the Vehicle Information and Communication System (VICS) may be used. Note that the traffic-related information distribution server 4 acquires the traffic-related information based on information provided by the police, road administrators, various public transportation administrators and the like, and probe information gathered from vehicles.

As shown in FIG. 1, the traffic-related information dictionary creating device 1 includes a communication unit 10, a controller (e.g., control unit 20), and a data storage unit 30.

A. Communication Unit

The communication unit 10 communicates through the network 2 with the provided information public server 3 and the traffic-related information distribution server 4. A known communication device may be used as the communication unit 10.

B. Control Unit

The control unit 20 controls the traffic-related information dictionary creating device 1. Specifically, the control unit 20 is a computer configured to include a CPU, various programs that are interpreted and executed in the CPU (including an OS and other basic control programs, and application programs that are activated in the OS to carry out specific functions), and an internal memory such as a RAM and ROM for storing the programs and various data. In particular, the traffic-related information dictionary creating program according to the present example is installed in the traffic-related information dictionary creating device 1 through any storage medium or the network 2, and configures various portions of the control unit 20 in substance.

The control unit 20 includes a provided information acquisition unit 21, a traffic-related information acquisition unit 22, and a traffic-related information dictionary registration unit 23 in terms of functional concept. The provided information acquisition unit 21 acquires the provided information and the position information that corresponds to the provided information from the provided information public server 3. The traffic-related information acquisition unit 22 acquires the traffic-related information from the traffic-related information distribution server 4. The traffic-related information dictionary registration unit 23 registers prescribed phrases in a traffic-related information dictionary. The processes executed by the various portions of the control unit 20 will be described in detail later.

C. Data Storage Unit

The data storage unit 30 is a storage unit that stores programs and various data required for operation of the traffic-related information dictionary creating device 1, and has a configuration that uses a magnetic storage medium such as a hard disk (not shown) as an external memory device, for example. However, any other storage mediums, including a semiconductor storage medium such as a flash memory or an optical storage medium such as a DVD or Blu-ray disc, can be used in place of or in combination with the hard disk.

The data storage unit 30 includes a keyword dictionary 31, a user dictionary 32, an area dictionary 33, and a traffic-related information dictionary 34.

The keyword dictionary 31 is a storage unit that stores phrases included in the provided information acquired by the provided information acquisition unit 21 from the provided information public server 3, FIG. 2 is a table that illustrates information stored in the keyword dictionary 31. As shown in FIG. 2, information that corresponds to the table item of Phrase, information that corresponds to the table item of Event, and information that corresponds to the table item of Total Usage are associated with each other and stored in the keyword dictionary 31. Information stored as corresponding to the Phrase item is a phrase included in the provided information acquired by the provided information acquisition unit 21 from the provided information public server 3 (e.g., "traffic congestion" and "jammed" in FIG. 2). Information stored as corresponding to the Event item specifies traffic-related events occurring at the position at which the provided information that includes the corresponding phrase is provided ("traffic congestion" in FIG. 2). Information stored as corresponding to the Total Usage item specifies the cumulative number of times the same phrase is included in the provided information that is provided within the range of the same type of occurring traffic-related event (e.g., "532" as the cumulative number of times the same phrase "traffic congestion" is included in the provided information that is provided within the range of the same type of occurring traffic-related event of "traffic congestion" in FIG. 2).

The user dictionary 32 is a storage unit that stores, per information provider of the provided information, phrases included in the provided information acquired by the provided information acquisition unit 21 from the provided information public server 3. FIG. 3 is a table that illustrates information stored in the user dictionary 32 for an information provider "AA." As shown in FIG. 3, information that corresponds to the table item of Phrase and information that corresponds to the table item of User Usage are associated with each other and stored in the user dictionary 32. Information stored as corresponding to the Phrase item is a phrase included in the provided information from an information provider that corresponds to the user dictionary 32, among the provided information acquired by the provided information acquisition unit 21 from the provided information public server 3 (e.g., "traffic congestion" and "jammed" in FIG. 3). Information stored as corresponding to the User Usage item specifies the number of times a corresponding phrase is included in the provided information from the information provider that corresponds to the user dictionary 32 (e.g., "30" for the phrase "traffic congestion" in FIG. 3).

The area dictionary 33 is a storage unit that stores, per area that includes the position at which the provided information is provided, phrases included in the provided information acquired by the provided information acquisition unit 21 from the provided information public server 3. Here, "area" is a concept that indicates, for example, a region of a given range such as an "AC district" or a zone that is delineated by any sort of boundary, including a given road section such as "from DB interchange to CA interchange" or the like. In the following description, a region of a given range will be used as an example. FIG. 4 is a table that illustrates information stored in the area dictionary 33 for the area "AC district" of a given range. As shown in FIG. 4, information that corresponds to the table item of Phrase and information that corresponds to the table item of Area Usage are associated with each other and stored in the area dictionary 33. Information stored as corresponding to the Phrase item is a phrase included in the provided information that is provided from a position included in an area that corresponds to the area dictionary 33 ("AC district" in the example of FIG. 4), among the provided information acquired by the provided information acquisition unit 21 from the provided information public server 3 (e.g., "traffic congestion" and "jammed" in FIG. 4). Information stored as corresponding to the Area Usage item specifies the number of times a corresponding phrase is included in the provided information that is provided from the position included in the area that corresponds to the area dictionary 33 (e.g., "145" for the phrase "traffic congestion" in FIG. 4). Note that information for specifying a range of an area that corresponds to the area dictionary 33 is added to each area dictionary 33 (e.g., coordinates for specifying the boundaries of the relevant area).

The traffic-related information dictionary 34 is a traffic-related information phrase storage unit that stores a phrase and a traffic-related event as associated with each other. FIG. 5 is a table that illustrates information stored in the traffic-related information dictionary 34. As shown in FIG. 5, information that corresponds to the table item of Phrase, information that corresponds to the table item of Event, and information that corresponds to the table item of Class are associated with each other and stored in the traffic-related information dictionary 34. Information stored as corresponding to the Phrase item is at least part of a phrase included in the provided information acquired by the provided information acquisition unit 21 from the provided information public server 3 (e.g., "traffic congestion" and "jammed" in FIG. 5). Information stored as corresponding to the Event item specifies traffic-related events occurring at the position at which the provided information that includes the corresponding phrase is provided ("traffic congestion" in FIG. 5). Information stored as corresponding to the Class item specifies the class of the corresponding phrase. Information that specifies a phrase generally used to express the corresponding traffic-related event ("all areas" in FIG. 5), provider identifying information that uniquely identifies the information provider of the provided information that includes the corresponding phrase ("AA" in FIG. 5), or information that specifies the area that includes the position at which the provided information that includes the corresponding phrase is provided ("AC district") is stored.

The timing at which various information is stored in the keyword dictionary 31, the user dictionary 32, the area dictionary 33, and the traffic-related information dictionary 34, and the source of the various information acquired will be described in detail later.

II. Processing

Figure 8:
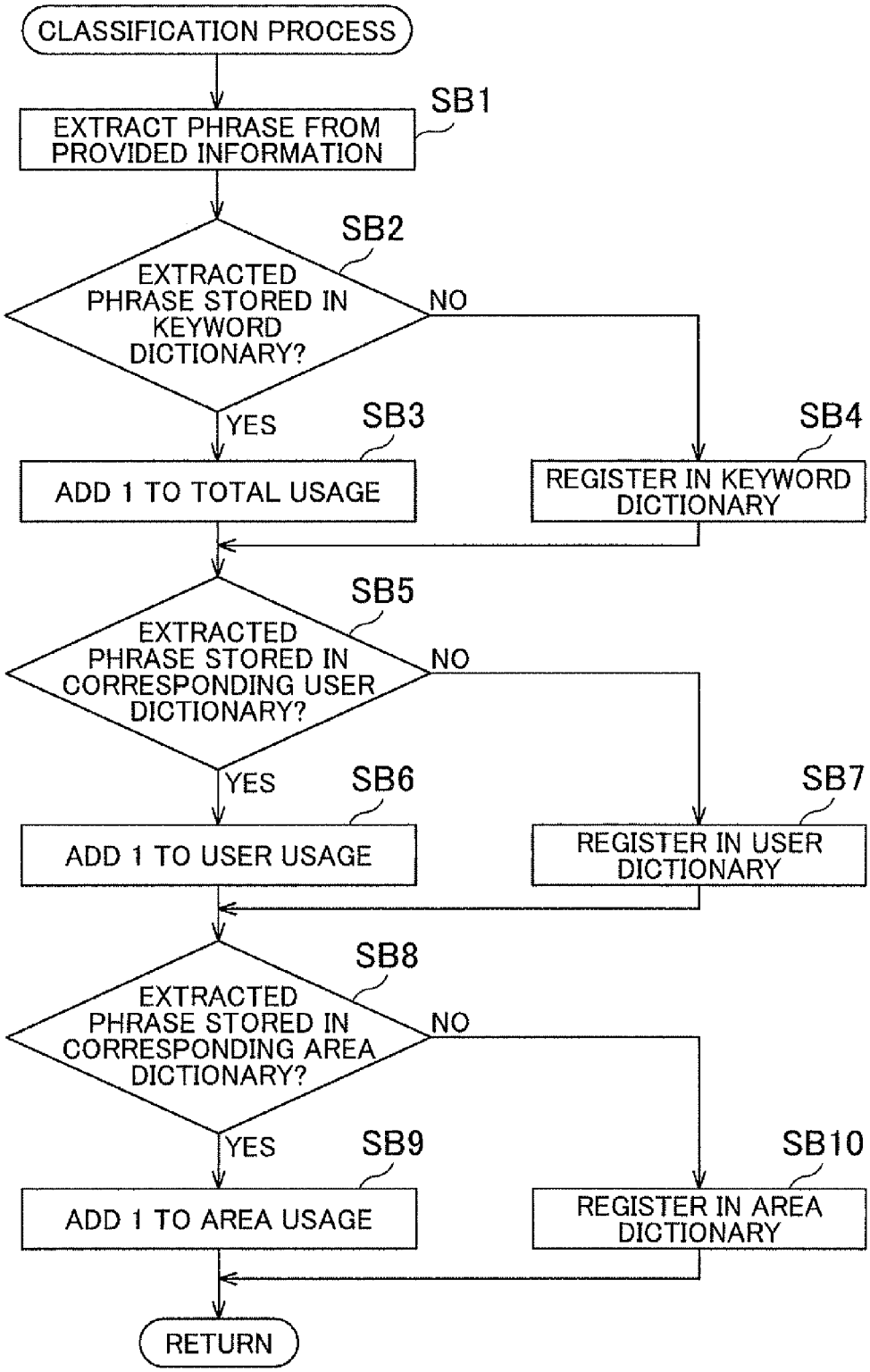
FIG. 8 is a flowchart of a classification algorithm.

Next, an exemplary traffic-related information dictionary creating method will be described with respect to the algorithms shown in FIGS. 6, 8, and 9. The method may be implemented in the form of a computer program that is stored in RAM and/or ROM and executable by the control unit 20. Although the structure of the above-described traffic-related information dictionary creating device 1 is referenced in the description of the method, the reference to such structure is exemplary, and the method need not be limited by the specific structure of the above-described traffic-related information dictionary creating device 1.

A. Keyword Dictionary Registration Process

First, the keyword dictionary registration process will be described. FIG. 6 is a flowchart of the keyword dictionary registration process (steps in the following description of each process are abbreviated as "S"). The keyword dictionary registration process is repeatedly initiated in a predetermined cycle after the traffic-related information dictionary creating device 1 is powered on, for example.

Figures 6, 7:
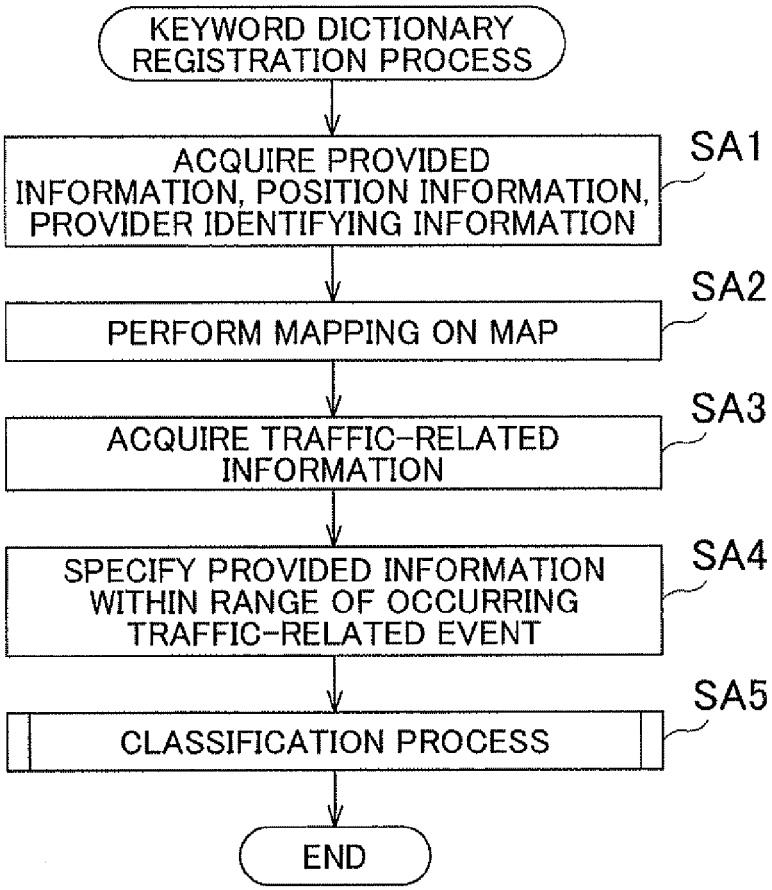
FIG. 6 is a flowchart of a keyword dictionary registration algorithm.
FIG. 7 is a table that illustrates provided information that is uploaded from a terminal to a provided information public server and stored in the provided information public server.

As shown in FIG. 6, after starting up the keyword dictionary registration process, the provided information acquisition unit 21 acquires from the provided information public server 3 the provided information, the position information that specifies the position at which the provided information is provided, and the provider identifying information that uniquely identifies the information provider of the provided information (SA1).

FIG. 7 is a table that illustrates the provided information that is uploaded from the terminal to the provided information public server 3 and stored in the provided information public server 3. As shown in FIG. 7, information that corresponds to the User item, information that corresponds to the Provided Information item, and information that corresponds to the Position Information item are associated with each other and stored by the provided information public server 3. Information that corresponds to the User item is the provider identifying information that uniquely identifies the information provider (e.g., "AA" in FIG. 7). A user ID required by the provider to access the provided information public server 3 from the terminal can be used as the provider identifying information, for example. The user ID is transmitted together with the provided information to the provided information public server 3 when the provided information is uploaded from the terminal to the provided information public server 3. Information that corresponds to the Provided Information item is provided by the information provider (e.g., "snail's pace!" in FIG. 7). Information that corresponds to the Position Information item specifies the position at which the provided information is provided (e.g., "x1, y1" in FIG. 7). Coordinates that indicate the current position of the specified terminal using GPS can be used as the position information, for example. The coordinates are transmitted together with the provided information to the provided information public server 3 when the provided information is uploaded from the terminal to the provided information public server 3, Each time the above information is uploaded from the terminal of each user to the provided information public server 3, the information is released in turn to the public. The provided information acquisition unit 21 acquires from the provided information public server 3 the provided information released by the provided information public server 3 during a period since the previous execution of the processing at SA1 until the current execution of the processing at SA1, as well as the provider identifying information and the position information associated with the provided information.

Returning to FIG. 6, based on the position information that corresponds to the provided information, the provided information acquisition unit 21 specifies the position at which the provided information acquired by the provided information acquisition unit 21 at SA1 is provided and performs mapping on a map (SA2).

Next, the traffic-related information acquisition unit 22 acquires the traffic-related information from the traffic-related information distribution server 4 (SA3). The traffic-related information acquisition unit 22 acquires, through the communication unit 10, the traffic-related information that corresponds to an occurring traffic-related event during the period since the previous execution of the processing at SA1 until the current execution of the processing at SA1, which is the traffic-related information distributed from the traffic-related information distribution server 4, for example.

Next, the traffic-related information dictionary registration unit 23 specifies the provided information that is provided within the range of the occurring traffic-related event, based on the position information acquired by the provided information acquisition unit 21 at SA1 and the traffic-related information acquired by the traffic-related information acquisition unit 22 at SA3 (SA4).

Specifically, among the information included in the traffic-related information acquired by the traffic-related information acquisition unit 22 at SA3, the traffic-related information dictionary registration unit 23 specifies the range in which the traffic-related event is occurring based on the information that specifies the range of the occurring traffic-related event. Here, the "information that specifies the range of the occurring traffic-related event" is link data included in map information used by a known navigation system, for example, and is configured using the link data that corresponds to a section in which the traffic-related event is occurring. The traffic-related information dictionary registration unit 23 specifies the provided information that is provided within the range of the occurring traffic-related event by comparing the range in which the specified traffic-related occurred and the positions mapped on the map by the provided information acquisition unit 21 at SA2 (positions at which the provided information acquired by the provided information acquisition unit 21 at SA1 is provided). At such time, the traffic-related information dictionary registration unit 23 associates the traffic-related event and the provided information that is provided within the range of the occurring traffic-related event with each other, and stores the associated traffic-related event and provided information in the RAM or the like.

Following the processing at SA4, the traffic-related information dictionary registration unit 23 executes, for each piece of provided information that was specified in the processing at SA4 as provided within the range of the occurring traffic-related event, a classification process for classifying a phrase included in the provided information (SA5). Following the processing at SA5, the control unit 20 ends the keyword dictionary registration process.

B. Classification Process

Here, the classification process will be described. FIG. 8 is a flowchart of the classification process. As shown in FIG. 8, after the classification process is started up, the traffic-related information dictionary registration unit 23 extracts a phrase included in the provided information that is provided within the range of the occurring traffic-related event (SB1). For example, using a known language processing technique such as a morphological analysis, the traffic-related information dictionary registration unit 23 extracts self-sufficient words such as verbs, adjectives, and nouns among the phase included in the provided information.

Next, the traffic-related information dictionary registration unit 23 determines whether the phrase extracted at SB1 is stored in the keyword dictionary 31 as associated with the traffic-related event occurring at the position at which the provided information including the phrase is provided (SB2). For example, the traffic-related information dictionary registration unit 23 acquires the traffic-related event stored in the RAM at SA4 in FIG. 6 as associated with the provided information including the phrase extracted at SB1, and determines whether the acquired traffic-related event and the phrase extracted at SB1 are associated with each other and stored in the keyword dictionary 31 shown in FIG. 2.

Returning to FIG. 8, if the determination result at SB2 is that the phrase extracted at SB1 is stored in the keyword dictionary 31 as associated with the traffic-related event occurring at the position at which the provided information including the phrase is provided (SB2: Yes), the traffic-related information dictionary registration unit 23 adds one to the information that corresponds to the Total Usage item, which is stored as associated with the phrase in the keyword dictionary 31 shown in FIG. 2 (SB3). For example, if the phrase "traffic congestion" is extracted at SB1 from the provided information that is provided within the range of the occurring traffic-related event "traffic congestion," one is added to the total usage of "532" that is stored as associated with the phrase "traffic congestion" in the keyword dictionary 31 of FIG. 2, such that the total usage becomes "533."

Returning to FIG. 8, if the determination result at SB2 is that the phrase extracted at SB1 is not stored in the keyword dictionary 31 as associated with the traffic-related event occurring at the position at which the provided information including the phrase is provided (SB2: No), the traffic-related information dictionary registration unit 23 registers the phrase extracted at SB1 in the keyword dictionary 31 (SB4). That is, the traffic-related information dictionary registration unit 23 stores the phrase extracted at SB1 in the keyword dictionary 31 as associated with the traffic-related event occurring at the position at which the provided information including the phrase is provided, and stores "1" as the corresponding total usage.

Following the processing at SB3 or SB4, the traffic-related information dictionary registration unit 23 determines whether the phrase extracted at SB1 is stored in the user dictionary 32 for the information provider of the provided information including the phrase (SB5). For example, based on the provided information including the phrase extracted at SB1 and the provider identifying information acquired by the provided information acquisition unit 21 at SA1, the traffic-related information dictionary registration unit 23 specifies the information provider of the provided information including the phrase extracted at SB1, and determines whether the phrase extracted at SB1 is stored in the user dictionary 32 for the specified information provider.

Accordingly, if the phrase extracted at SB1 is stored in the user dictionary 32 for the information provider of the provided information including the phrase (SB5: Yes), the traffic-related information dictionary registration unit 23 adds one to the information that corresponds to the User Usage item, which is stored as associated with the phrase in the user dictionary 32 shown in FIG. 3 (SB6). For example, if the phrase "traffic congestion" is extracted at SB1 from the provided information from the information provider "AA," one is added to the user usage of "30" that is stored as associated with the phrase "traffic congestion" in the user dictionary 32 of FIG. 3, such that the user usage becomes "31."

Returning to FIG. 8, if the determination result at SB5 is that the phrase extracted at SB1 is not stored in the user dictionary 32 for the information provider of the provided information including the phrase (SB5: No), the traffic-related information dictionary registration unit 23 registers the phrase extracted at SB1 in the user dictionary 32 for the information provider (SB7). That is, the traffic-related information dictionary registration unit 23 stores the phrase extracted at SB1 in the user dictionary 32 for the information provider, and stores "1" as the corresponding user usage. Note that if there is no user dictionary 32 in the data storage unit 30 for the information provider of the provided information including the phrase, the traffic-related information dictionary registration unit 23 newly provides the user dictionary 32 for the information provider in the data storage unit 30, and registers the phrase extracted at SB1 in that particular user dictionary 32.

Following the processing at SB6 or SB7, the traffic-related information dictionary registration unit 23 determines whether the phrase extracted at SB1 is stored in the area dictionary 33 for the area that includes the position at which the provided information including the phrase is provided (SB8). For example, based on the provided information including the phrase extracted at SB1 and the position information acquired by the provided information acquisition unit 21 at SA1, the traffic-related information dictionary registration unit 23 specifies the position at which the provided information including the phrase extracted at SB1 is provided, and determines whether the phrase extracted at SB1 is stored in the area dictionary 33 for the area that includes the specified position. Note that, for example, whether the areas that respectively correspond to the area dictionaries 33 are "the area that includes the position at which the provided information is provided" is determined by the traffic-related information dictionary registration unit 23 based on information for specifying the range of the area that corresponds to a particular area dictionary 33 added to the area dictionaries 33.

Accordingly, if the phrase extracted at SB1 is stored in the area dictionary 33 for the area that includes the position at which the provided information including the phrase is provided (SB8: Yes), the traffic-related information dictionary registration unit 23 adds one to the information that corresponds to the Area Usage item, which is stored as associated with the phrase in the area dictionary 33 shown in FIG. 4 (SB9). For example, if the phrase "traffic congestion" is extracted at SB1 from the provided information that is provided at the position included in the area "AC district," one is added to the area usage of "145" that is stored as associated with the phrase "traffic congestion" in the area dictionary 33 of FIG. 4, such that the area usage becomes "146."

Returning to FIG. 8, if the determination result at SB8 is that the phrase extracted at SB1 is not stored in the area dictionary 33 for the area that includes the position at which the provided information including the phrase is provided (SB8: No), the traffic-related information dictionary registration unit 23 registers the phrase extracted at SB1 in the area dictionary 33 for the area (SB10). That is, the traffic-related information dictionary registration unit 23 stores the phrase extracted at SB1 in the area dictionary 33 for the area, and stores "1" as the corresponding area usage. Note that if there is no area dictionary 33 in the data storage unit 30 for the area that includes the position at which the provided information including the phrase is provided, the traffic-related information dictionary registration unit 23 newly provides the area dictionary 33 for the area in the data storage unit 30, and registers the phrase extracted at SB1 in that particular area dictionary 33.

Following the processing at SB9 or SB10, the control unit 20 ends the classification process and returns to the main routine.

C. Traffic-Related Information Dictionary Registration Process

Next, the traffic-related information dictionary registration process will be described. FIG. 9 is a flowchart of the traffic-related information dictionary registration process. After the traffic-related information dictionary creating device 1 is powered on, the traffic-related information dictionary registration process is repeatedly initiated each time the keyword dictionary registration process is executed a prescribed number of times, for example.

Figure 9:
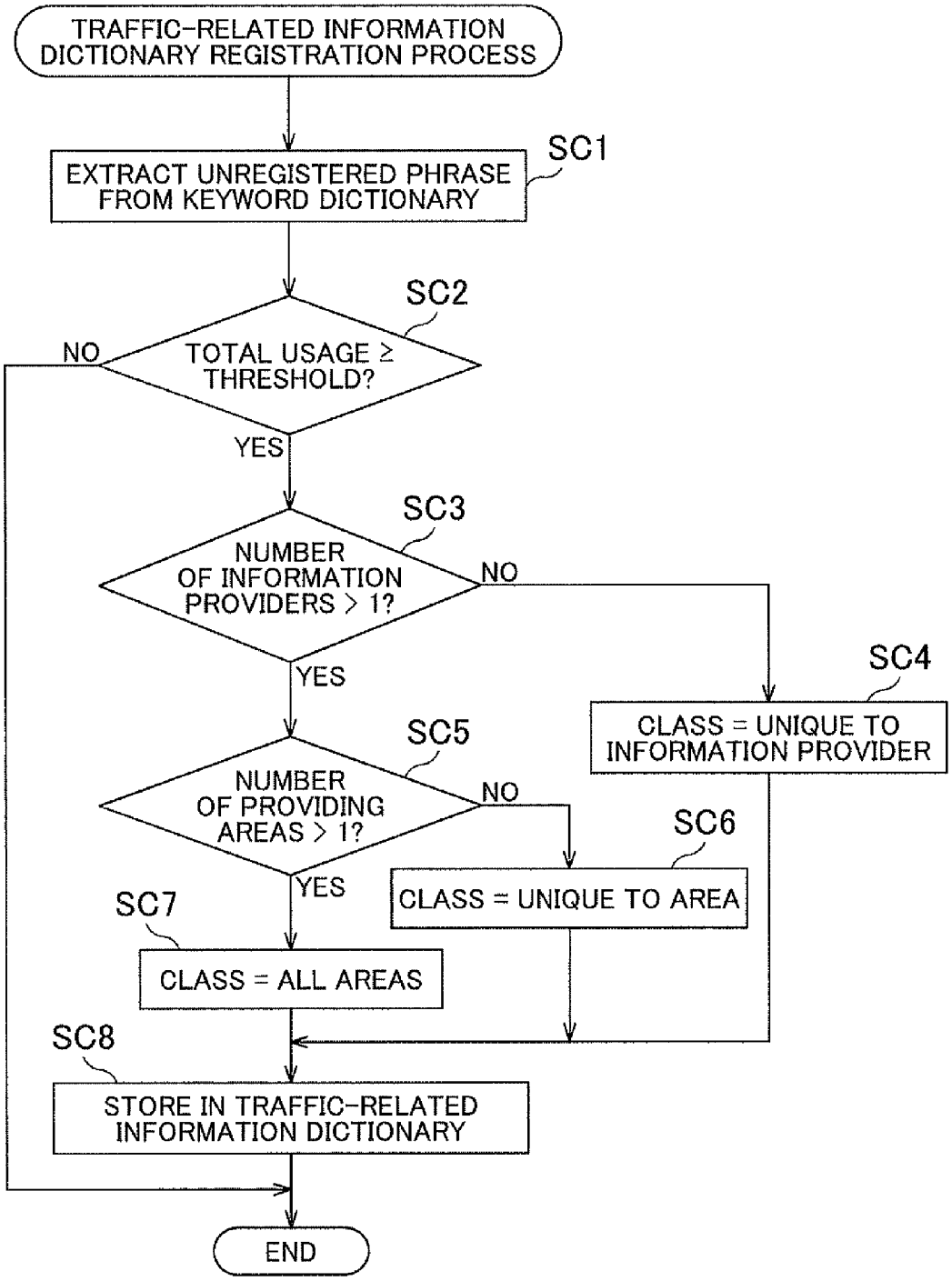
FIG. 9 is a flowchart of a traffic-related information dictionary registration algorithm.

As shown in FIG. 9, after the traffic-related information dictionary registration process is started up, the traffic-related information dictionary registration unit 23 extracts a phrase not stored in the traffic-related information dictionary 34 from among the phrases stored in the keyword dictionary 31 (SC1).

Next, the traffic-related information dictionary registration unit 23 determines whether the cumulative number of times the same phrase extracted at SC1 is included in the provided information that is provided within the range of the same type of occurring traffic-related event is equal to or greater than a threshold (SC2). That is, the traffic-related information dictionary registration unit 23 refers to the keyword dictionary 31 illustrated in FIG. 2 to determine whether the Total Usage item stored as associated with the phrase extracted at SC1 is equal to or greater than the threshold. The threshold may be any specific value, for example, a value of 10 may be used.

Accordingly, if the cumulative number of times the same phrase extracted at SC1 is included in the provided information that is provided within the range of the same type of occurring traffic-related event is not equal to or greater than the threshold (is less than the threshold) (SC2: No), the traffic-related information dictionary registration unit 23 determines that the phrase is not yet used enough to be registered in the traffic-related information dictionary 34, and ends the traffic-related information dictionary registration process.

However, if the cumulative number of times the same phrase extracted at SC1 is included in the provided information that is provided within the range of the same type of occurring traffic-related event is equal to or greater than the threshold (SC2: Yes), the traffic-related information dictionary registration unit 23 determines that the phrase is used enough to be registered in the traffic-related information dictionary 34, and determines whether the number of information providers of the provided information including the phrase is greater than one (SC3). Specifically, if the number of user dictionaries 32 that store the phrase extracted at SC1 is greater than one, the traffic-related information dictionary registration unit 23 determines that the number of information providers of the provided information including the phrase is greater than one.

Accordingly, if the number of information providers of the provided information including the phrase extracted at SC1 is not greater than one (SC3: No), that is, if the number of user dictionaries 32 that store the phrase extracted at SC1 is one, the traffic-related information dictionary registration unit 23 classifies the phrase as a phrase unique to the information provider of the provided information including the phrase (SC4). At such time, the traffic-related information dictionary registration unit 23 stores the classification result in the RAM, for example.

However, if it is determined at SC3 that the number of information providers of the provided information including the phrase extracted at SC1 is greater than one (SC3: Yes), that is, if the number of user dictionaries 32 that store the phrase extracted at SC1 is greater than one, the traffic-related information dictionary registration unit 23 determines whether the number of areas that include the position at which the provided information including the phrase is provided is greater than one (SC5). Specifically, if the number of area dictionaries 33 that store the phrase extracted at SC1 is greater than one, the traffic-related information dictionary registration unit 23 determines that the number of areas that include the position at which the provided information including the phrase is provided is greater than one.

Accordingly, if the number of areas that include the position at which the provided information including the phrase extracted at SC1 is provided is not greater than one (SC5: No), that is, if the number of area dictionaries 33 that store the phrase extracted at SC1 is one, the traffic-related information dictionary registration unit 23 classifies the phrase as a phrase unique to the area that includes the position at which the provided information including the phrase is provided (SC6). At such time, the traffic-related information dictionary registration unit 23 stores the classification result in the RAM, for example.

However, if the number of areas that include the position at which the provided information including the phrase extracted at SC1 is provided is greater than one (SC5: Yes), that is, if the number of area dictionaries 33 that store the phrase extracted at SC1 is greater than one, the traffic-related information dictionary registration unit 23 determines that the extracted phrase is a phrase generally used to express the traffic-related event that corresponds to the extracted phrase, and classifies the extracted phrase as a phrase of "all areas," which indicates a general phrase (SC7). At such time, the traffic-related information dictionary registration unit 23 stores the classification result in the RAM, for example.

Following the processing at SC4, SC6, or SC7, the traffic-related information dictionary registration unit 23 stores the phrase extracted at SC1 in the traffic-related information dictionary 34 in accordance with the classification result at SC4, SC6, or SC7 (SC8). That is, the traffic-related information dictionary registration unit 23 stores information that specifies the traffic-related event associated with the phrase extracted at SC1 and stored in the keyword dictionary 31, and information that corresponds to the classification result at SC4, SC6, or SC7.

For example, the phrase "traffic congestion" may be extracted at SC1 from the keyword dictionary 31 illustrated in FIG. 2, and the classification of the phrase "traffic congestion" may be designated as "all areas" at SC7. In such case, as shown in FIG. 5, the traffic-related information dictionary registration unit 23 associates the phrase "traffic congestion" with the traffic-related event "traffic congestion" stored in the keyword dictionary 31 as associated with the phrase, and also with the classification "all areas" indicative of the classification result at SC7, and stores the associated phrase, event, and classification in the traffic-related information dictionary 34.

Alternatively, the phrase "BA congestion" may be extracted at SC1 from the keyword dictionary 31 illustrated in FIG. 2 (e.g., a phrase that refers to traffic congestion occurring near a facility BA), and the classification of the phrase "BA congestion" may be designated as "unique to the area that includes the position at which the provided information including the phrase is provided" at SC6. In such case, as shown in FIG. 5, the traffic-related information dictionary registration unit 23 associates the phrase "BA congestion" with the traffic-related event "BA congestion" stored in the keyword dictionary 31 as associated with the phrase, and, as information that corresponds to the classification result at SC7, with the classification "AC district" indicative of the area that includes the position at which the provided information including the phrase is provided. The traffic-related information dictionary registration unit 23 also stores the associated phrase, event, and classification in the traffic-related information dictionary 34. Thus, in addition to phrases generally used to express the traffic-related event, phrases used only in a prescribed area can also be registered in the traffic-related information dictionary 34 as area-specific phrases that express the traffic-related event.

As another example, the phrase "snail's pace" may be extracted at SC1 from the keyword dictionary 31 illustrated in FIG. 2, and the classification of the phrase "snail's pace" may be designated as "unique to the information provider of the provided information including the phrase" at SC4. In such case, as shown in FIG. 5, the traffic-related information dictionary registration unit 23 associates the phrase "snail's pace" with the traffic-related event "snail's pace" stored in the keyword dictionary 31 as associated with the phrase, and, as information that corresponds to the classification result at SC4, with the classification "AA" indicative of the information provider of the provided information including the phrase. The traffic-related information dictionary registration unit 23 also stores the associated phrase, event, and classification in the traffic-related information dictionary 34. Thus, in addition to phrases generally used to express the traffic-related event, phrases used only by a prescribed information provider can also be registered in the traffic-related information dictionary 34 as information provider-specific phrases that express the traffic-related event.

Following the processing at SC8, the control unit 20 ends the traffic-related information dictionary registration process.

III. Effects

According to the present example as described above, based on the position information acquired by the provided information acquisition unit 21 and the traffic-related information acquired by the traffic-related information acquisition unit 22, the provided information that is provided within the range of the occurring traffic-related event is specified. In addition, at least part of a phrase included in the specified provided information is associated with the occurring traffic-related event, and the associated at least partial phrase and traffic-related event are stored in the traffic-related information dictionary 34. Therefore, even a phrase not generally used as a phrase to express a traffic-related event can be registered in the traffic-related information dictionary 34 as a phrase that expresses that particular traffic-related event.

In addition, the traffic-related information dictionary registration unit 23 determines whether to store the phrase in the traffic-related information dictionary 34 based on the cumulative number of times the same phrase is included in the provided information that is provided within the range of the same type of occurring traffic-related event. Therefore, only a phrase used to a certain extent for the same type of traffic-related event can be registered in the traffic-related information dictionary 34, which increases the reliability of the traffic-related information dictionary 34.

The traffic-related information dictionary registration unit 23 associates the phrase included in the provided information that is provided within the range of the occurring traffic-related event with the provider identifying information that corresponds to the provided information including the phrase, and stores the associated phrase and provider identifying information in the traffic-related information dictionary 34. Therefore, a phrase used only by a prescribed information provider and not generally used as a phrase that expresses the traffic-related event can also be registered in the traffic-related information dictionary 34 as an information provider-specific phrase that expresses the traffic-related event.

Based on the position information acquired by the provided information acquisition unit 21, the traffic-related information dictionary registration unit 23 associates the phrase included in the provided information that is provided within the range of the occurring traffic-related event with the area that includes the position at which the provided information including the phrase is provided, and stores the associated phrase and area in the traffic-related information dictionary 34. Therefore, a phrase used only in a prescribed area and not generally used as a phrase that expresses the traffic-related event can also be registered in the traffic-related information dictionary 34 as an area-specific phrase that expresses the traffic-related event.

IV. Modifications

While various features have been described in conjunction with the examples outlined above, various alternatives, modifications, variations, and/or improvements of those features and/or examples may be possible. Accordingly, the examples, as set forth above, are intended to be illustrative. Various changes, including the examples discussed below, may be made without departing from the broad spirit and scope of the underlying inventive principles.

The problems to be solved by and the effects of the inventive principles described herein are not limited to the implementations described above and may vary depending on the environment in which the principles are practiced and the detailed configuration of the resulting implementations. The above problems may be only partially solved, and the above effects only partially achieved.

A. Traffic-Related Information Dictionary Creating Device

Although a location at which to install the traffic-related information dictionary creating device 1 is not specifically mentioned in the example described above, the traffic-related information dictionary creating device 1 may be mounted in a vehicle as part of a car navigation device, or mounted in a portable type of information terminal such as a smartphone, for example.

B. Traffic-Related Events

In the example described above, as an example, the provided information is provided within the range of the occurring traffic congestion serving as the traffic-related event. However, the relevant traffic-related events are not limited to traffic congestion. Using the traffic-related information dictionary creating device 1 similar to the above example, a phrase that expresses the traffic-related event can be registered in the traffic-related information dictionary 34 even when the provided information is provided within the range of any other occurring traffic-related event (e.g., traffic restrictions, road work, accidents, public events, weather, road slipperiness, space availability in parking lots, and status of train delays).

C. Position Information

In the example described above, as an example of the position information that specifies the position at which the provided information is provided, coordinates indicative of the current position of the terminal specified using GPS are transmitted from the terminal to the provided information public server 3 together with the provided information. However, other information may be used as the position information. For example, as the position information, information intentionally added by the information provider to the provided information in order to indicate the position at which the provided information is provided (e.g., a link to a webpage that displays a specific position on a map) may be used, or information indicative of the position included in the provided information itself (e.g., "BB" in the provided information of "I am now at BB") may be specified using a known language analysis technique and such information used as the position information.

What is claimed is:

1. A traffic-related information learning device that is communicably connectable through a network to a social networking server and a traffic-related information distribution server, the traffic-related information learning device comprising:

a memory storing traffic-related information phrases, each traffic-related information phrase being associated with a traffic related event; and a processor that:

acquires a social network message and position information that corresponds to the social network message from the social network server, the social network message having been provided to the social network server by a social network service and stored in the social network server with the position information, the position information specifying a position at which the social network message was provided to the social network service a user of the social network service;

acquires traffic-related information from the traffic-related information distribution server, the traffic-related information including:

information that specifies an occurring traffic-related event; and information that specifies a location affected by the occurring traffic-related event;

based on the acquired position information and the acquired traffic-related information, determines whether the position at which the social network message was provided is within the location affected by the occurring traffic-related event;

when the position at which the social network message was provided is within the location affected by the occurring traffic-related event:

extracts a phrase that expresses the traffic related event from the provided social network message; and associates the extracted phrase with the occurring traffic-related event;

stores the associated phrase and the occurring traffic-related event in the memory; and when queried with an input traffic related event, refers to the memory and outputs a stored traffic-related information phrase to be used to describe the input traffic related event.

2. The traffic-related information learning device according to claim 1, wherein the processor:

determines whether to store the extracted phrase in the memory based on a cumulative number of times the same phrase is extracted from a social network message provided at a position that is within the location affected by the occurring traffic-related event.

3. The traffic-related information learning device according to claim 1, wherein:

user identifying information that uniquely identifies the user of the social network service is associated with the social network message in the social network server; and the processor:

acquires the user identifying information from the social network server;

associates the extracted phrase with the acquired user identifying information; and stores the associated extracted phrase and the user identifying information in the memory.

4. The traffic-related information learning device according to claim 1, wherein the processor:

based on the acquired position information, associates the extracted phrase with an area that includes the position at which the social network message was provided; and stores the associated extracted phrase and the area in the memory.

5. A traffic-related information learning method comprising:

acquiring, with a processor, a social network message and position information that corresponds to the social network message from a social network server, the social network message having been provided to the social network server by a social network service and stored in the social network server with the position information, the position information specifying a position at which the social network message was provided to the social network service by a user of the social network service;

acquiring, with the processor, traffic-related information from the traffic-related information distribution server, the traffic-related information including:

information that specifies an occurring traffic-related event; and information that specifies a location affected by the occurring traffic-related event;

based on the acquired position information and the acquired traffic-related information, determining, with the processor, whether the position at which the social network message was provided is within the location affected by the occurring traffic-related event;

when the position at which the social network message was provided is within the location affected by the occurring traffic-related event:

extracting, with the processor, a phrase that expresses the traffic related event from the provided social network message; and associating, with the processor, the extracted phrase with the occurring traffic-related event;

storing, with the processor, the associated phrase and the occurring traffic-related event in the memory; and when queried with an input traffic related event, referring to the memory and outputting, with the processor, a stored traffic-related information phrase to be used to describe the input traffic related event.

6. The traffic-related information learning method according to claim 5, further comprising:

determining, with the processor, whether to store the extracted phrase in the memory based on a cumulative number of times the same phrase is extracted from a social network message provided at a position that is within the location affected by the occurring traffic-related event.

7. The traffic-related information learning method according to claim 5, wherein:

user identifying information that uniquely identifies the user of the social network service is associated with the social network message in the social network server; and the method further comprises:

acquiring, with the processor, the user identifying information from the social network server;

associating, with the processor, the extracted phrase with the acquired user identifying information; and storing, with the processor, the associated extracted phrase and the user identifying information in the memory.

8. The traffic-related information learning method according to claim 5, further comprising:

based on the acquired position information, associating, with the processor, the extracted phrase with an area that includes the position at which the social network message was provided; and storing, with the processor, the associated extracted phrase and the area in the memory.

9. A non-transitory computer-readable storage medium storing a computer-executable traffic-related information learning program, the program comprising:

instructions for acquiring a social network message and position information that corresponds to the social network message from a social network server, the social network message having been provided to the social network server by a social network service and stored in the social network server with the position information, the position information specifying a position at which the social network message was provided to the social network service by a user of the social network service;

instructions for acquiring traffic-related information from the traffic-related information distribution server, the traffic-related information including:

information that specifies an occurring traffic-related event; and information that specifies a location affected by the occurring traffic-related event;

instructions for, based on the acquired position information and the acquired traffic-related information, determining whether the position at which the social network message was provided is within the location affected by the occurring traffic-related event;

instructions for, when the position at which the social network message was provided is within the location affected by the occurring traffic-related event:

extracting a phrase that expresses the traffic related event from the provided social network message; and associating a phrase included in the identified provided information with the occurring traffic-related event; and instructions for storing the associated phrase and the occurring traffic-related event in the memory; and instructions for, when queried with an input traffic related event, referring to the memory and outputting a stored traffic-related information phrase to be used to describe the input traffic related event.

10. The storage medium according to claim 9, the program further comprising:

instructions for determining whether to store the extracted phrase in the memory based on a cumulative number of times the same phrase is extracted from a social network message provided at a position that is within the location affected by the occurring traffic-related event.

11. The storage medium according to claim 9, wherein:

user identifying information that uniquely identifies the user of the social network service is associated with the social network message in the social network server; and the program further comprises:

instructions for acquiring the user identifying information from the social network server;

instructions for associating the extracted phrase with the acquired user identifying information; and instructions for storing the associated extracted phrase and the user identifying information in the memory.

12. The storage medium according to claim 9, the program further comprising:

instructions for, based on the acquired position information, associating the extracted phrase with an area that includes the position at which the social network message was provided; and instructions for storing the associated extracted phrase and the area in the memory.

* * * * *